US010837737B1

(12) United States Patent
Wright

(10) Patent No.: US 10,837,737 B1
(45) Date of Patent: Nov. 17, 2020

(54) LED ILLUMINATING WEAPON SIGHTING SYSTEM

(71) Applicant: Jimmie L. Wright, Rockledge, FL (US)

(72) Inventor: Jimmie L. Wright, Rockledge, FL (US)

( * ) Notice: Subject to any disclaimer, the term of this patent is extended or adjusted under 35 U.S.C. 154(b) by 0 days.

(21) Appl. No.: 15/666,180

(22) Filed: Aug. 1, 2017

Related U.S. Application Data

(60) Provisional application No. 62/369,771, filed on Aug. 2, 2016.

(51) Int. Cl.

| | |
|---|---|
| ***F41G 1/34*** | (2006.01) |
| ***F41G 1/01*** | (2006.01) |
| ***F41G 1/033*** | (2006.01) |
| ***F41G 1/08*** | (2006.01) |
| ***F41G 11/00*** | (2006.01) |
| *F21S 9/02* | (2006.01) |
| *F21V 23/06* | (2006.01) |
| *F21Y 115/10* | (2016.01) |

(52) U.S. Cl.
CPC ..... *F41G 1/345* (2013.01); *F41G 1/01* (2013.01); *F41G 1/033* (2013.01); *F41G 1/08* (2013.01); *F41G 11/003* (2013.01); *F21S 9/02* (2013.01); *F21V 23/06* (2013.01); *F21Y 2115/10* (2016.08)

(58) Field of Classification Search
CPC . F41G 1/345; F41G 1/01; F41G 1/033; F41G 1/08; F41G 1/16
USPC ... 42/111, 113, 130–132, 135–137, 140, 148
See application file for complete search history.

(56) References Cited

U.S. PATENT DOCUMENTS

| | | | | |
|---|---|---|---|---|
| 878,857 | A | 2/1908 | Bevier | |
| 1,257,713 | A | 2/1918 | Johnson | |
| D235,339 | S | 6/1975 | Edstrom | |
| 4,533,980 | A * | 8/1985 | Hayes | F41G 1/345 359/889 |
| 5,083,034 | A * | 1/1992 | Frank | F41J 2/02 250/494.1 |
| 5,735,070 | A * | 4/1998 | Vasquez | F41A 9/62 42/1.02 |
| 6,622,415 | B1 * | 9/2003 | Canaday | F41G 1/26 42/112 |
| 6,732,467 | B1 * | 5/2004 | Luth | F41G 1/16 42/138 |
| 6,779,290 | B1 | 8/2004 | Houtsma | |
| D526,380 | S | 8/2006 | Swan | |
| 7,356,962 | B2 | 4/2008 | Swan | |
| D594,083 | S | 6/2009 | Mayberry et al. | |
| 7,627,976 | B1 * | 12/2009 | Olson | F41G 1/345 42/132 |
| D615,144 | S | 5/2010 | Mayberry et al. | |
| D635,634 | S | 4/2011 | Swan | |
| D637,259 | S | 5/2011 | Swan | |

(Continued)

*Primary Examiner* — Jonathan C Weber
(74) *Attorney, Agent, or Firm* — Nelson Mullins Riley & Scarborough, LLP

(57) ABSTRACT

Systems, devices, and methods for mounting front and rear IR and visible LEDs sights on weapons. The LEDs illuminate the sights in low light environments unlike modern day iron sights. The LED sights allow a shooter the ability to see both sights, and acquire the sights in low light without projecting any visible light. The sights being battery powered with an on/off and dimmer switch giving the shooter ability to use the sights at their convenience without projecting light.

16 Claims, 15 Drawing Sheets

(56) References Cited

U.S. PATENT DOCUMENTS

D637,261 S 5/2011 Swan
7,954,971 B1 * 6/2011 Kincaid ..... F41C 33/0254 362/110
8,015,744 B1 9/2011 Swan
D648,413 S 11/2011 Mayberry et al.
8,147,089 B2 * 4/2012 Matthews ..... F21L 4/027 362/199
8,191,302 B1 * 6/2012 Swan ..... F41G 1/04 362/110
D675,281 S 1/2013 Speroni
8,484,882 B2 7/2013 Haley et al.
8,607,495 B2 * 12/2013 Moore ..... F41G 1/36 42/114
8,627,591 B2 * 1/2014 Moore ..... F41G 11/003 42/114
D705,890 S 5/2014 Fitzpatrick et al.
8,925,237 B2 * 1/2015 Howe ..... F41G 1/345 42/132
9,322,615 B2 * 4/2016 Raybman ..... F41G 1/17
10,088,274 B2 * 10/2018 Howe ..... F41G 1/345
10,180,306 B2 * 1/2019 Ben Zion ..... F41G 1/345
2003/0140546 A1 7/2003 Kay
2009/0013581 A1 * 1/2009 LoRocco ..... F41G 1/345 42/132
2009/0193705 A1 * 8/2009 LoRocco ..... F41G 1/30 42/123
2010/0058640 A1 * 3/2010 Moore ..... F41G 1/35 42/114
2010/0077645 A1 * 4/2010 LoRocco ..... F41G 1/30 42/113
2010/0083554 A1 * 4/2010 Elpedes ..... F41G 1/14 42/123
2010/0091485 A1 * 4/2010 Matthews ..... F21L 4/027 362/234
2011/0154712 A1 * 6/2011 Moore ..... F41G 1/35 42/115
2011/0173871 A1 * 7/2011 Moore ..... F41G 1/35 42/114
2011/0225867 A1 * 9/2011 Moore ..... F41G 1/35 42/114
2012/0110886 A1 * 5/2012 Moore ..... F41G 1/35 42/114
2012/0151817 A1 * 6/2012 Howe ..... F41G 1/345 42/132
2014/0041277 A1 * 2/2014 Hamilton ..... F41G 1/345 42/122
2014/0157645 A1 * 6/2014 Moore ..... F41G 1/35 42/114
2015/0153136 A1 * 6/2015 Howe ..... F41G 1/345 42/111
2015/0153137 A1 * 6/2015 Newzella ..... F41G 1/01 42/140
2017/0146318 A1 * 5/2017 Plummer ..... F41G 1/345
2018/0164061 A1 * 6/2018 Downing ..... G06K 9/00
2018/0172399 A1 * 6/2018 Ben Zion ..... F41G 1/01
2018/0231350 A1 * 8/2018 Howe ..... F41G 1/345
2019/0219813 A1 * 7/2019 Summerfield ..... F41G 1/345

* cited by examiner

LED ILLUMINATING WEAPON SIGHTING SYSTEM

CROSS REFERENCE TO RELATED APPLICATIONS

This application claims the benefit of priority to U.S. Provisional Application Ser. No. 62/369,771 filed Aug. 2, 2016, the entire disclosure of which is incorporated by reference in its' entirety.

FIELD OF INVENTION

This invention relates to sights on weapons, and in particular to systems, devices, and methods for mounting front and rear IR and visible LEDs sights on weapons, so the LEDs illuminate the sights in low light environments. allowing a shooter, the ability to see both sights, and acquire sights in low light without projecting any visible light and being battery powered with an on/off and dimmer switch giving the shooter ability to use at their convenience without projecting light.

BACKGROUND AND PRIOR ART

Iron sights are a system of shaped alignment markers (usually metal) used as sighting devices to assist in the aiming of a device such as a firearm, crossbow, or telescope, and exclude the use of optics as in telescopic sights or reflector (reflex) sights.

The earliest and most simple iron sights are fixed and cannot be easily adjusted. Many iron sights can be adjustable, so that the sights can be adjusted for windage and elevation.

On many firearms the rear sight is adjustable for elevation or windage. Rear sights are usually mounted in a dovetail on the barrel or receiver, closer to the eye of the shooter, allowing for easy visual pick-up of the notch.

Front sights can be mounted to the barrel by dovetailing, sweat soldering, screwing, or staking close to the muzzle and on a ramp. Some front sight assemblies include a detachable hood intended to reduce glare and if the hood is circular, then this provides a reference where the eye will naturally align one within the other.

With typical blade or post iron sights, the shooter would center the front post in the notch of the rear sight and the tops of both sights should be level. Since the eye is only capable of focusing on one plane, and the rear sight, front sight, and target are all in separate planes, only one of those three planes can be in focus. Which plane is in focus depends on the type of sight, and one of the challenges to a shooter is to keep the focus on the correct plane to allow for best sight alignment.

Different types of iron sights have included three-dot, white outline rear, straight eight, sight inserts, bar/dot or express sight, gold bead, night sights, and fiber optic.

For the three-dot, on semi-automatic handguns, the most common type of enhancement is a bright white dot painted on the front sight near the top of the blade, and a dot on each side of the rear sight notch. In low lighting conditions, the front sight dot is centered horizontally between the rear sight dots, with the target placed above the middle (front) dot. Some sight vendors offer differently colored dots for the front and rear sights.

The white outline rear is a contrast variation which uses a dot front sight with a thick and bright white outline around the rear sight notch.

For the straight eight, Heinie Specialty Products produces a variant of high visibility sights in which a single dot front sight and a rear notch with a dot below can be lined up vertically to form a figure "eight".

Sight inserts can be popular on revolvers, where the enhancement includes a colored plastic insert in the front sight blade, usually red or orange in color.

The bar/dot or express sight is similar to the straight eight type, which can be traditional on express rifles and is also found on some handguns. The open, V-shaped rear allows for faster acquisition and wider field of view, though less accurate for longer range precision type shooting. The dot on the front sight is aligned or set directly above the vertical bar on the rear sight, commonly referred to as "dotting the "I".

The gold bead which generally includes a colored dot on an end of a shotgun barrel is preferred by many competitors in IPSC (International Practical Shooting Confederation) and IDPA (International Defensive Pistol Association) shooting.

Night sights are used on tactical firearms, where enhancements can include trasers containing tritium gas whose radioactive decay causes a fluorescent material to glow. Self-luminous tritium sights provide visibility in extremely low light situations where normal sights would be degraded or useless. The tritium glow is not noticeable in bright conditions such as during daylight however. As a result, some manufacturers have started to integrate fiber optic sights with tritium vials to provide bright, high-contrast firearms sights in both bright and dim conditions. However, tritium usually gives off a constant light.

Short pieces of optical fibers for the dots is a growing trend, started on air rifles and muzzleloaders, made in such a way that ambient light falling on the length of the fiber is concentrated at the tip, making the dots slightly brighter than the surroundings. This method is most commonly used in front sights, but many makers offer sights that use fiber optics on front and rear sights. Fiber optic sights can now be found on handguns, rifles, and shotguns, both as aftermarket accessories and a growing number of factory guns.

Modern day iron sights are ineffective in low light due to the shooters inability to see both front and rear components of the system.

SUMMARY OF THE INVENTION

A primary objective of this invention is to provide systems, devices, and methods for mounting front and rear LED illuminating sights on weapons that use the lights to illuminate both the front and rear sights to make them useful in low light environments (dusk, darkness and dawn).

A secondary objective of this invention is to provide systems, devices, and methods for mounting front and rear IR (infrared lights) LED (light emitting diode) sights on weapons so that military and law enforcement shooters have the ability acquire sights in low light environments (dusk, darkness and dawn) without projecting any visible lights when using night vision goggles.

A third objective of this invention is to provide systems, devices, and methods for mounting front and rear LED illuminating sights on weapons being battery powered with an on/off dimmer allowing the shooter use without projecting light. The dimmer being adjustable between low IR to high IR light to off, or between low visible to high visible light to off.

A fourth objective of this invention is to provide systems, devices, and methods for mounting front and rear LED illuminating sights on weapons which allows projected light to be adjusted up to no visible light emissions, unlike tritium sights which gives off a constant light.

An LED illuminating weapon sighting system, can include a rear sight assembly for mounting on an automatic weapon, adapted to be closest to a shooters eye, the rear sight assembly including a rear LED (light emitting diode) lighting system, and a front sight post assembly for mounting on the weapon adjacent to a muzzle of the weapon, the front sight assembly including a front LED (light emitting diode) lighting system, wherein the rear sight assembly and the front sight post assembly are adapted to align with the shooters eye and target to create a sight picture and the rear LED lighting system and the front LED lighting system are adapted to assist the shooter to acquire the sight picture in low light environments.

The rear LED lighting system and the front LED lighting system can each include IR (Infrared) LED light used for night vision illumination and a visible LED light used for standard illumination without the night vision illumination.

The rear LED lighting system can include a rear fiber optic rod and a rear fiber optic board positioned about a rear aperture, with a circle etched onto the rear fiber optic board, wherein turning on the rear sight assembly will channel light from the IR LED light and the visible LED light to illuminate the etched circle with the IR LED light or the visible LED light.

The front LED lighting system can include a front fiber optic rod and a front fiber optic board inside of a front sight post, wherein turning on the front sight assembly will channel light from the IR LED light and the visible LED light to illuminate the front sight post with the IR LED light or the visible LED light The rear LED lighting system can include a rear battery power supply and a rear switch for turning on the rear LED lighting system and for adjusting brightness of the rear IR LED light source and the rear visible LED light source.

The rear switch can include a rotary switch.

The rear LED lighting system can include a windage adjuster to move a rear sight left or right to correct direction of the rear sight assembly.

The front LED lighting system can include a front battery power supply and a front switch for turning on the rear LED lighting system and for adjusting brightness of the front IR LED light source and the front visible LED light source. The front switch can include a rotary switch.

The front sight post in the front LED lighting system can include a telescoping adjustable front sight post for sighting elevation of the target.

The front sight assembly and the rear sight assembly can each include clamps for mounting the front sight assembly and the rear sight assembly about picatinny rails on the weapon.

The front sight assembly and the rear sight assembly can each include clamps for mounting the front sight assembly and the rear sight assembly about M-lok rails on the weapon.

The front sight assembly and the rear sight assembly can each include clamps for mounting the front sight assembly and the rear sight assembly about KeyMod rails on the weapon.

The front sight assembly and the rear sight assembly can each include pivot members for allowing upper portions on the front sight assembly and the rear sight assembly to fold up when being used and fold down when not being used.

The rear LED lighting system and the front LED lighting system can each include an IR (Infrared) LED light used for night vision illumination.

The rear LED lighting system and the front LED lighting system can each include a visible LED light used for standard illumination without the night vision illumination.

Another embodiment of an LED illuminating weapon sighting system, can include a rear sight assembly for mounting on an automatic weapon, adapted to be closest to a shooters eye, a front sight post assembly for mounting on the weapon adjacent to a muzzle of the weapon and an LED lighting system, wherein the rear sight assembly and the front sight post assembly are adapted to align with the shooters eye and target to create a sight picture and the LED lighting system is adapted to assist the shooter to acquire the sight picture in low light environments.

The LED lighting system can include a rear fiber optic rod and a rear fiber optic board positioned about a rear aperture, with a circle etched onto the rear fiber optic board, wherein turning on the rear sight assembly will channel light from an IR LED light and a visible LED light to illuminate the etched circle with the IR LED light or the visible LED light.

The LED lighting system can include a front fiber optic rod and a front fiber optic board inside of a front sight post, wherein turning on the front sight assembly will channel light from an IR LED light and a visible LED light to illuminate the front sight post with the IR LED light or the visible LED light.

Further objects and advantages of this invention will be apparent from the following detailed description of the presently preferred embodiments which are illustrated schematically in the accompanying drawings.

BRIEF DESCRIPTION OF THE FIGURES

The drawing figures depict one or more implementations in accord with the present concepts, by way of example only, not by way of limitations.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification does not include all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

A list of components will now be described.

Figure 1:
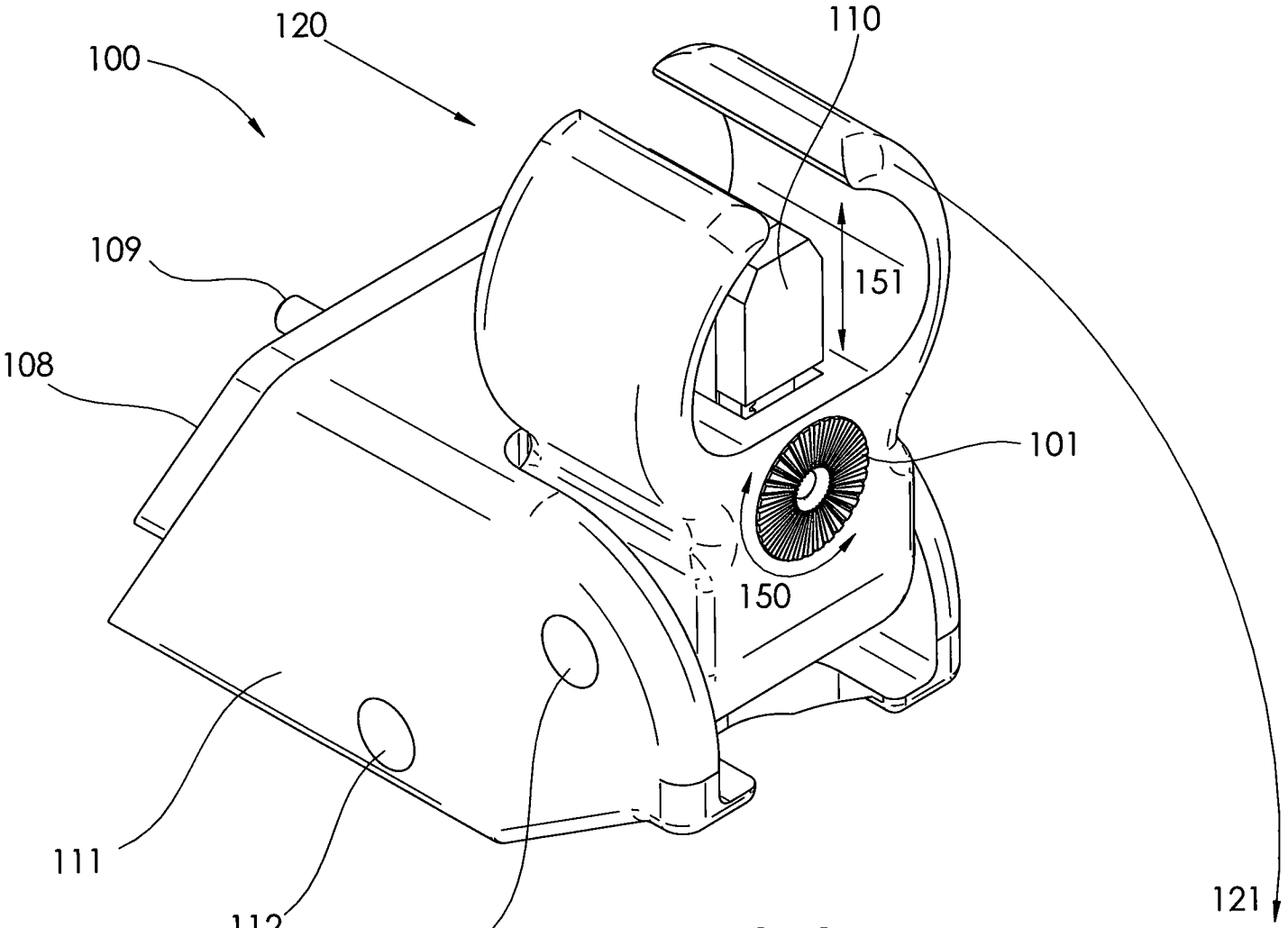
FIG. 1 is an upper front perspective view of the front sight post assembly for the LED (light emitting diode) illuminating weapon lighting system.
Figure 1A:
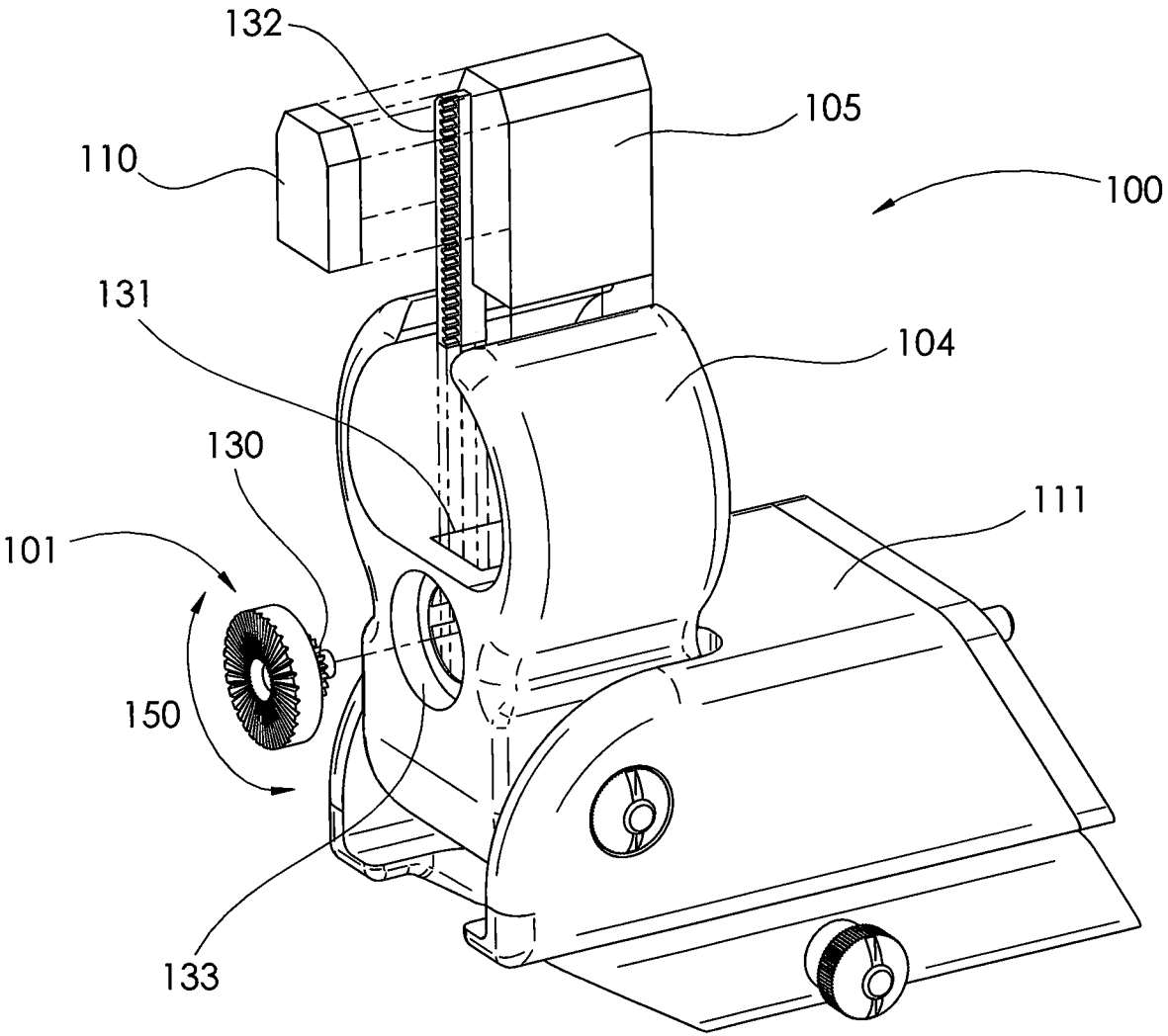
FIG. 1A is a partial exploded view of the elevation knob, vertical gear and the front sight fiber optic board housing with fiber optic board in the front sight post assembly of FIG. 1.
Figure 1B:
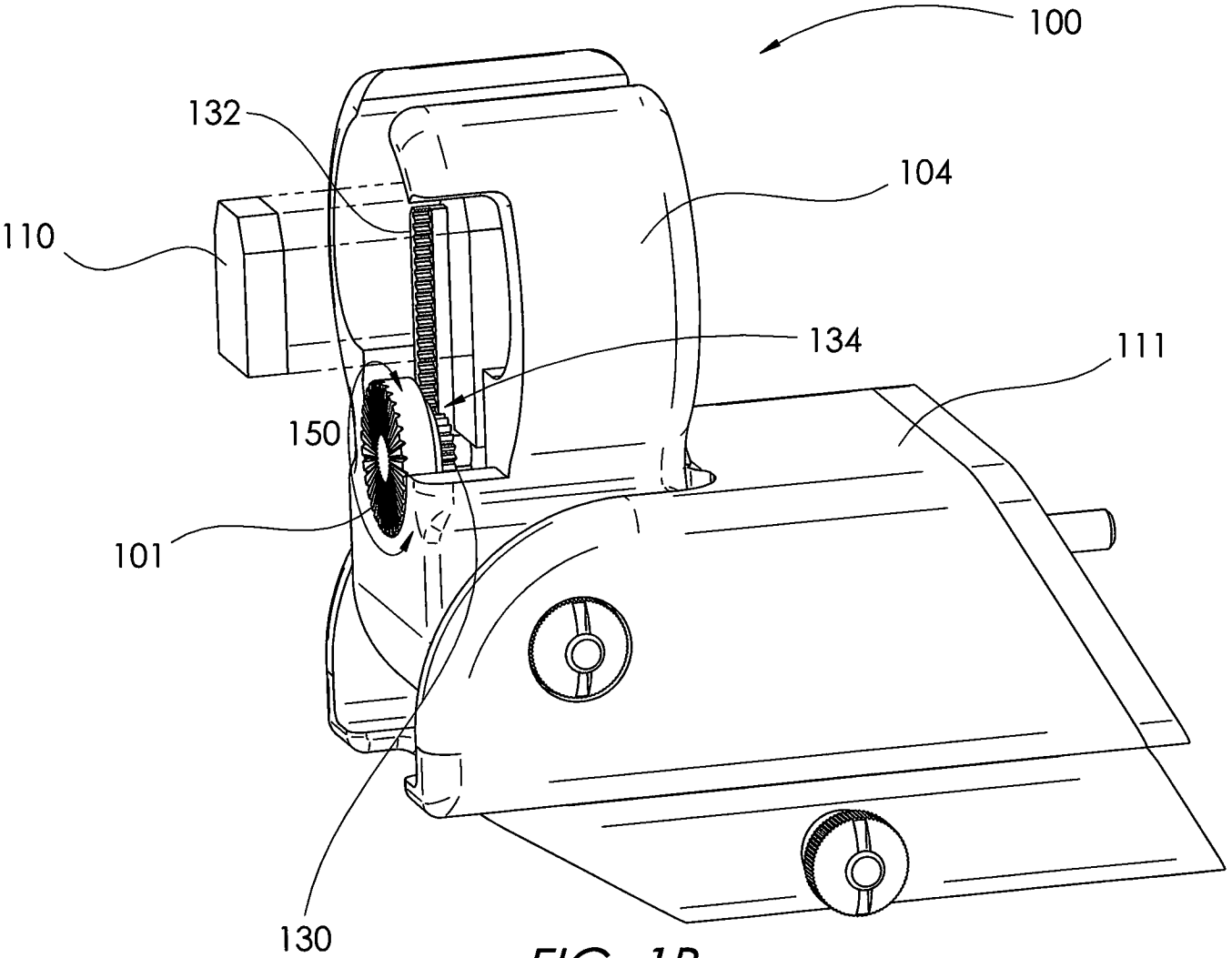
FIG. 1B is a partially assembled view of the elevation knob with vertical gear and gear contact point in the front sight post assembly of FIG. 1A.

100—Front sight post assembly
101—Elevation knob
104—Front sight post guard
105—Front sight fiber optic board housing
106—Fiber optic board
107—90 degree lock
108—Electronic front cap
109—Rotary switch
110—Elevation gear cap
111—Base
112—Picatinny lock bolt
113—Pivot pin/bolt
120—Direction of view
121—Folding direction 90/180 degree
122—Pivot pin end cap
123—Picatinny bolt nut
124—Picatinny housing
125—Picatinny channel
126I—LED IR (infra red) bulb having a wavelength between approximately 700/750 nm to approximately 1 mm
126V—LED Visible bulb having a wavelength between approximately 390 nm to less than approximately 700/750 nm
127—battery, such as but not limited to a 3V battery
128—Fiber optic rod
129—90 degree lock base
130—Horizontal gear
131—Front sight post housing
132—Vertical gear
134—Gear contact point
140—Sight alignment
141—Target
150—Left/Right rotation
151—Up/Down movement for elevation
200—Rear sight assembly
201—round aperture
205—Fiber optic board
206—Rear sight reticle housing
211—Base
220—Direction of view
221—90/180 degree direction
230—Windage adjustment knob
233—Windage screw
250—Left/Right movement
251—Left/Right rotation for windage adjustment
231—Windage adjustment base
234—Windage adjustment screw nut
301—Picatinny rail FIG. 1 is an upper front perspective view of the front sight post assembly 100 for the LED (light emitting diode) illuminating weapon lighting system. FIG. 1A is a partial exploded view of the elevation knob 101 which can rotate right clockwise or left counter-clockwise in the direction of arrow 150, vertical gear 132 and the front sight fiber optic board housing 105 with fiber optic board 106 (FIG. 2) in the front sight post assembly 100 of FIG. 1. FIG. 1B is a partially assembled view of the elevation knob 101 with vertical gear 132 and gear contact point 134 in the front sight post assembly 100 of FIG. 1A with gear cap 110 removed.

Figure 2:
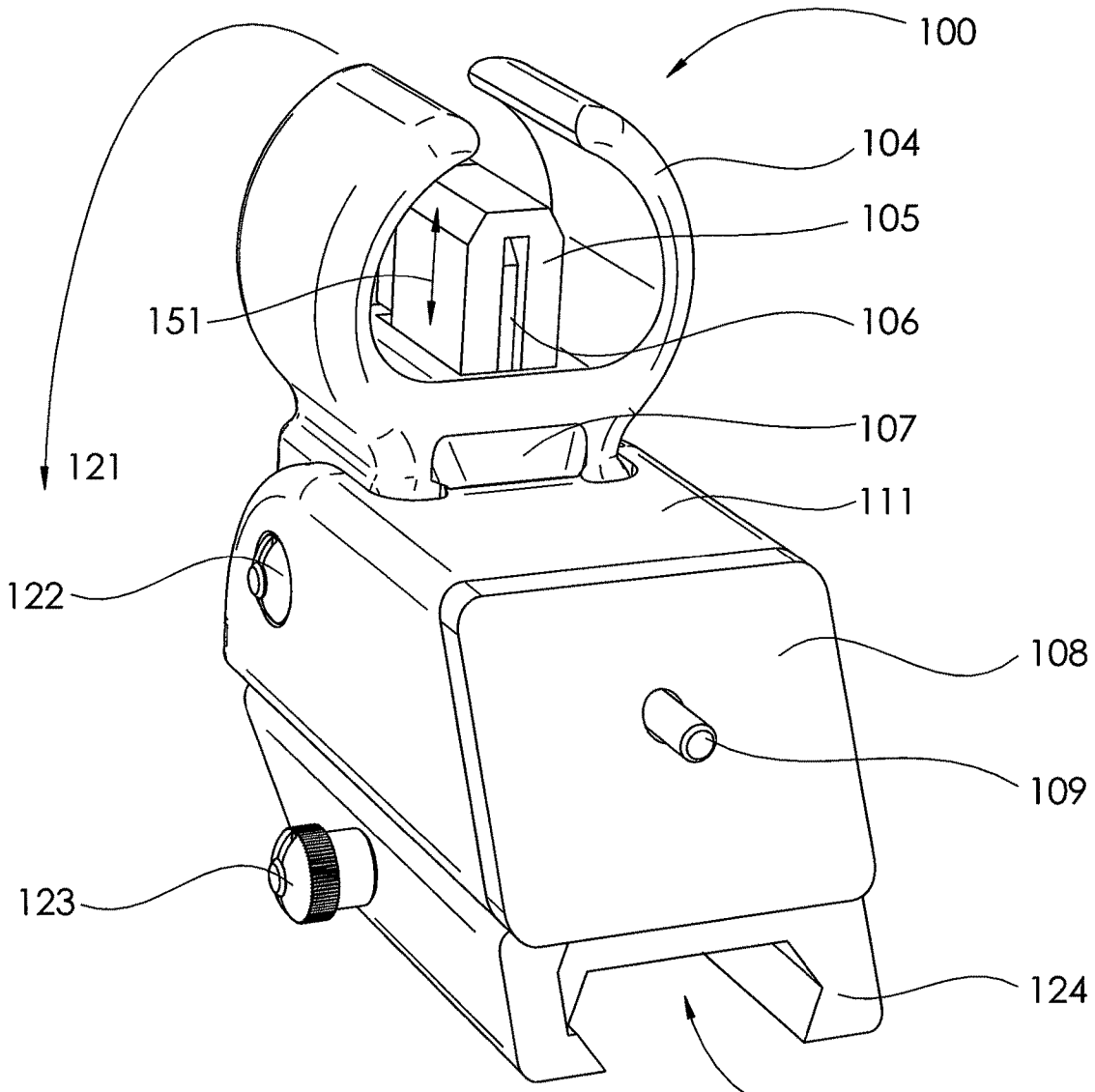
FIG. 2 is a rear perspective view of the front sight post assembly of FIG. 1.
Figure 3:
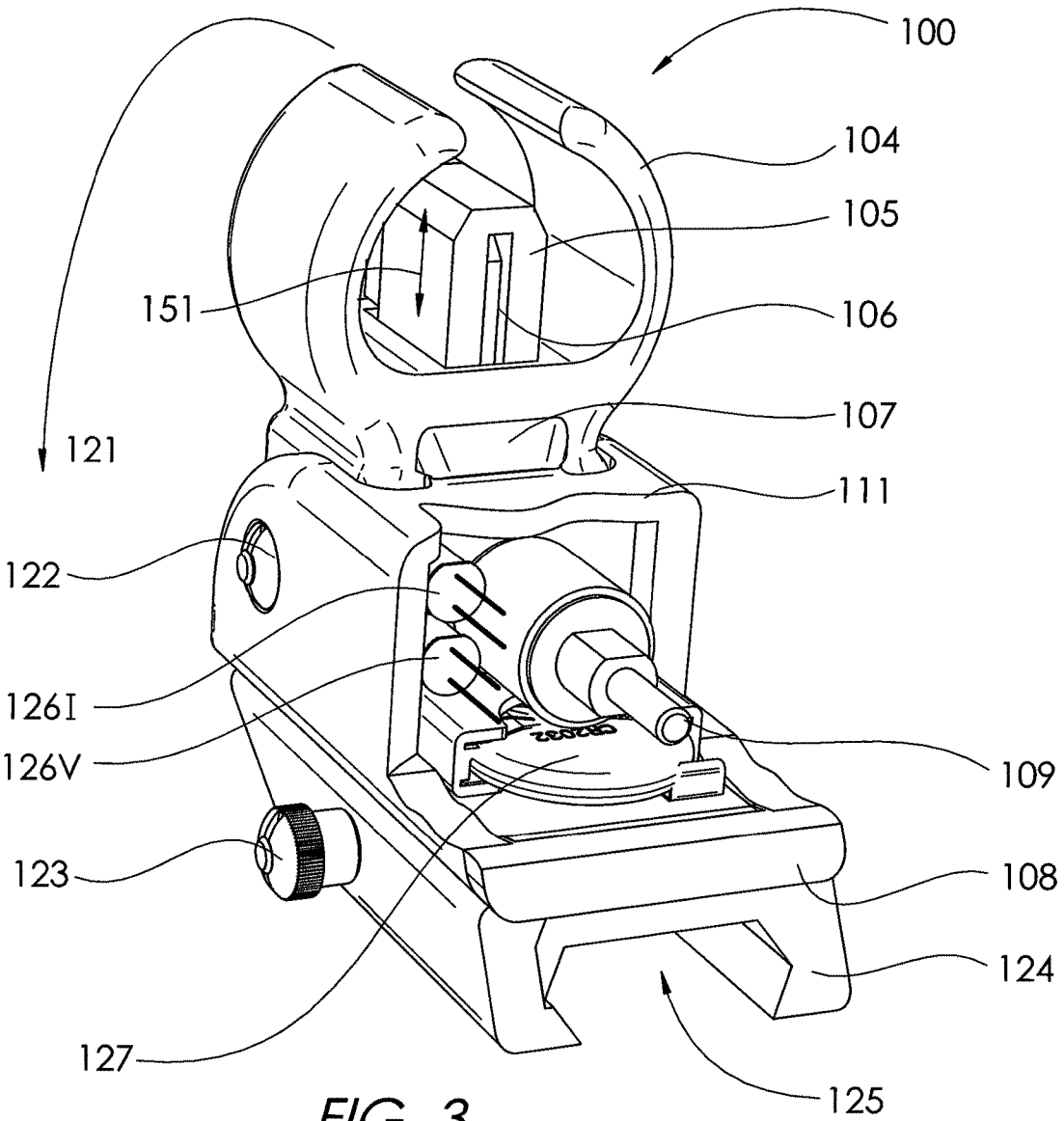
FIG. 3 is another rear perspective view of the front sight post assembly of FIG. 2 without a front cap.
Figure 5:
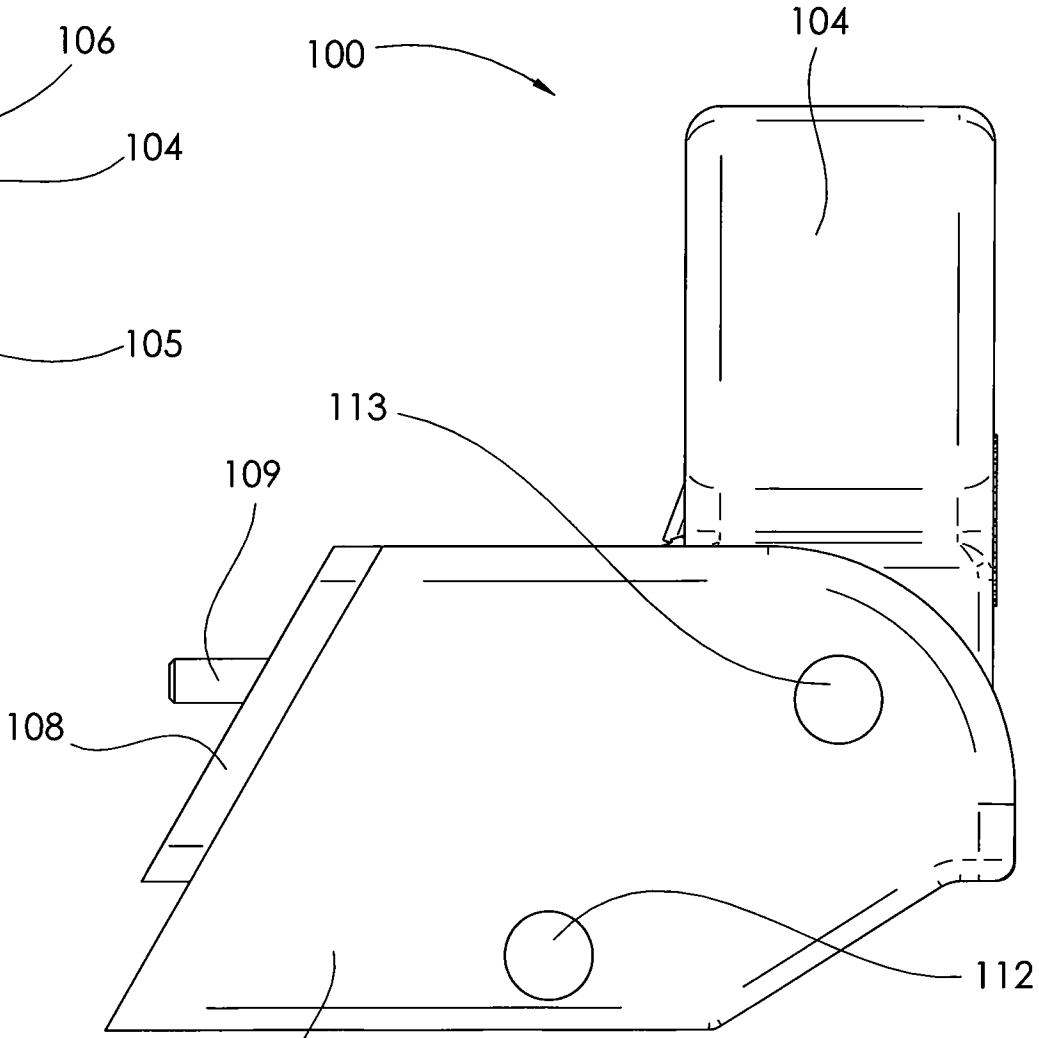
FIG. 5 is a right side view of the front sight post assembly of FIG. 2.
Figure 4:
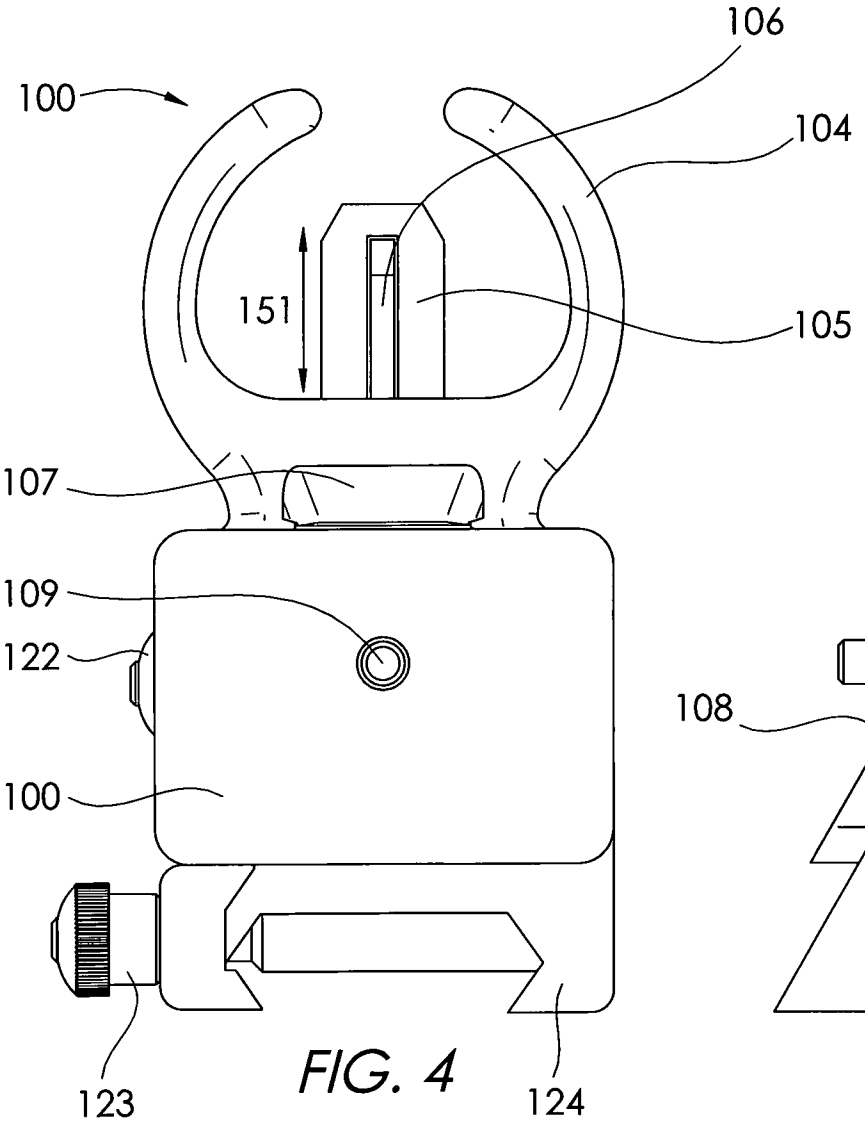
FIG. 4 is a rear view of the front sight post assembly of FIG. 2.
Figure 6:
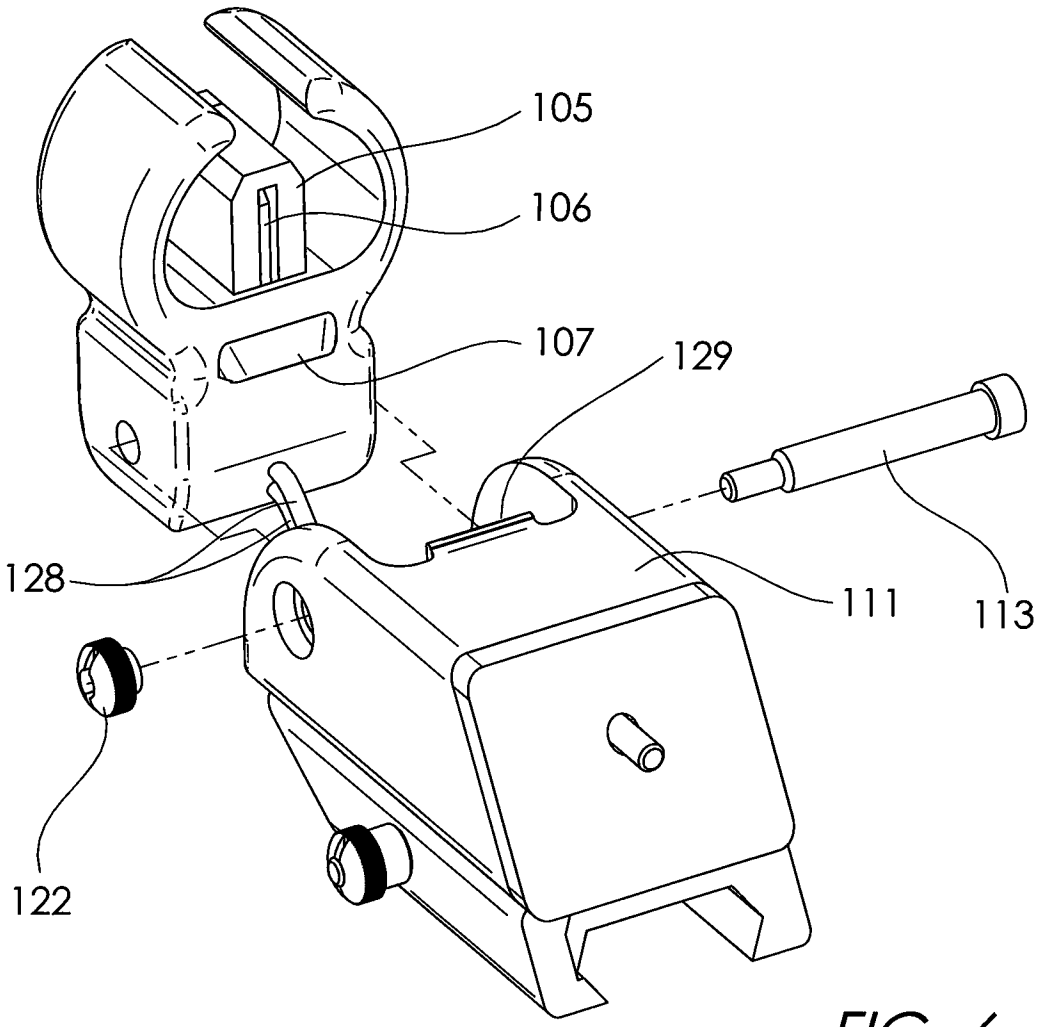
FIG. 6 is a partial exploded rear perspective view of the front sight post assembly of FIG. 2 with pivot pin, bolt, and front sight and fiber optic rods.

FIG. 2 is a rear perspective view of the front sight post assembly 100 of FIG. 1. FIG. 3 is another rear perspective view of the front sight post assembly 100 of FIG. 2 without a front cap 108. FIG. 4 is a rear view of the front sight post assembly 100 of FIG. 2. FIG. 5 is a right side view of the front sight post assembly 100 of FIG. 2. FIG. 6 is a partial exploded rear perspective view of the front sight post assembly 100 of FIG. 2 with pivot pin 113, pivot pin end cap 122, and front sight and fiber optic rods 128.

Figure 7:
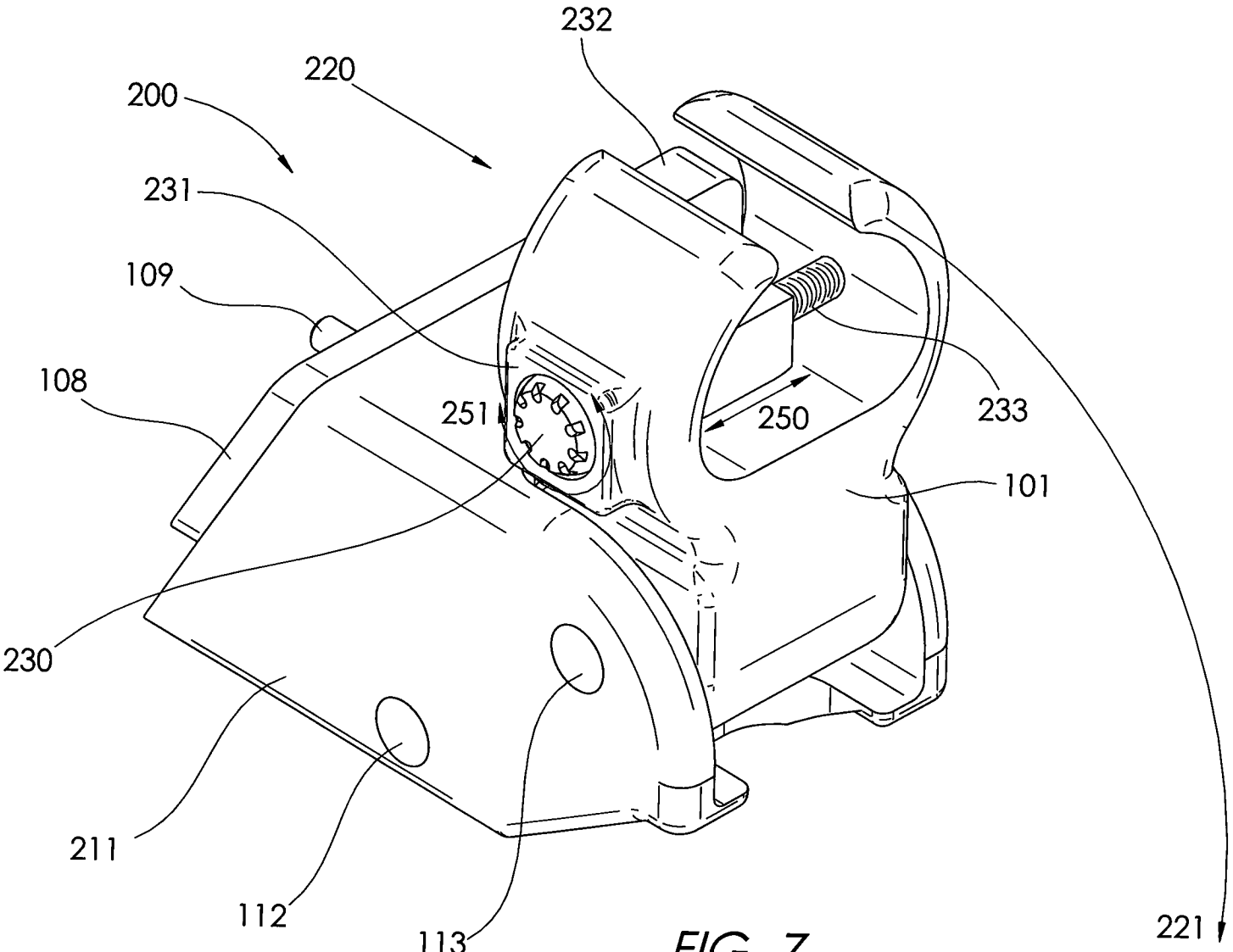
FIG. 7 is an upper front perspective view of the rear sight assembly for the LED (light emitting diode) illuminating weapon lighting system.
Figure 8:
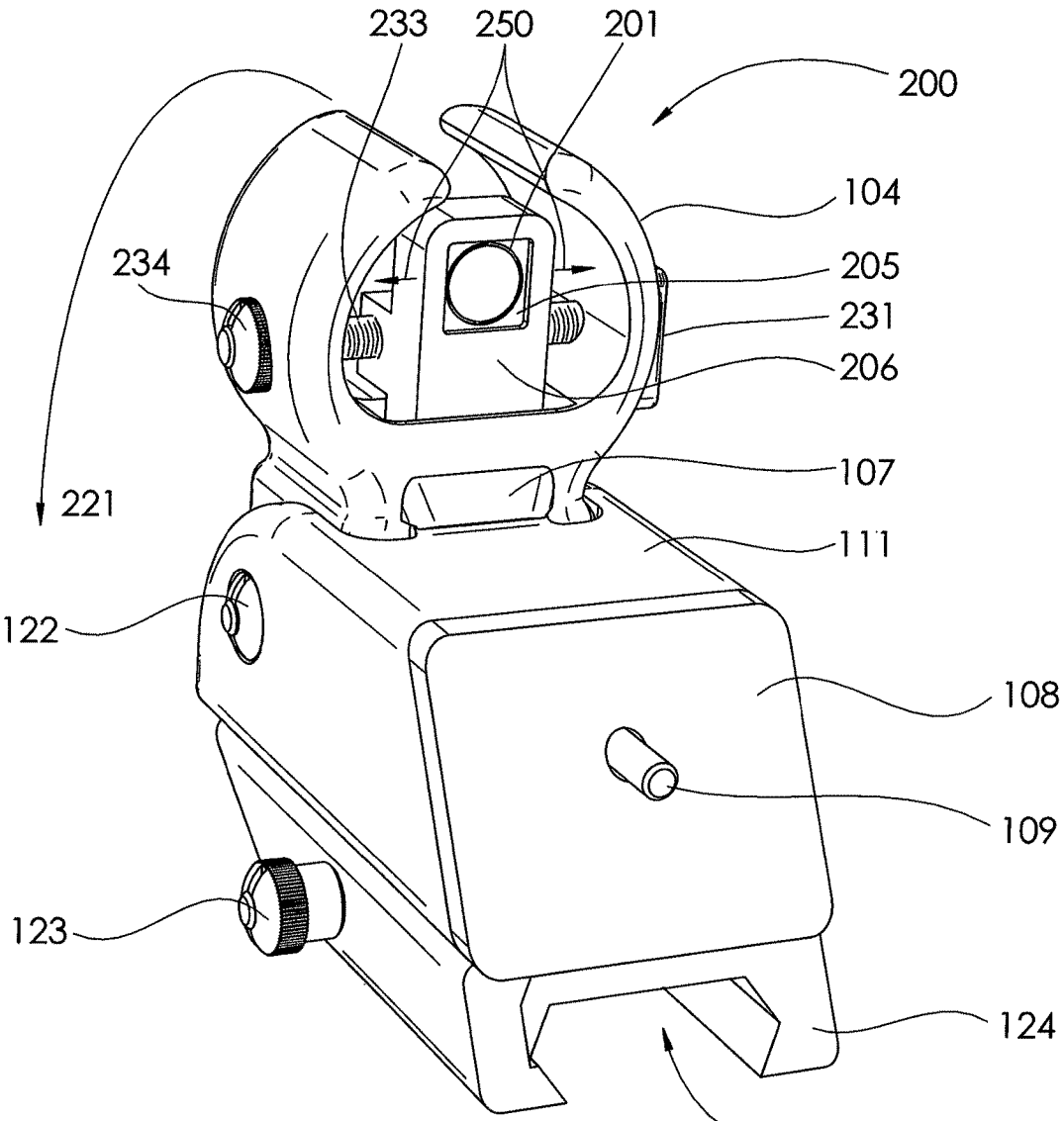
FIG. 8 is an upper rear perspective view of the rear sight assembly of FIG. 7.
Figure 9:
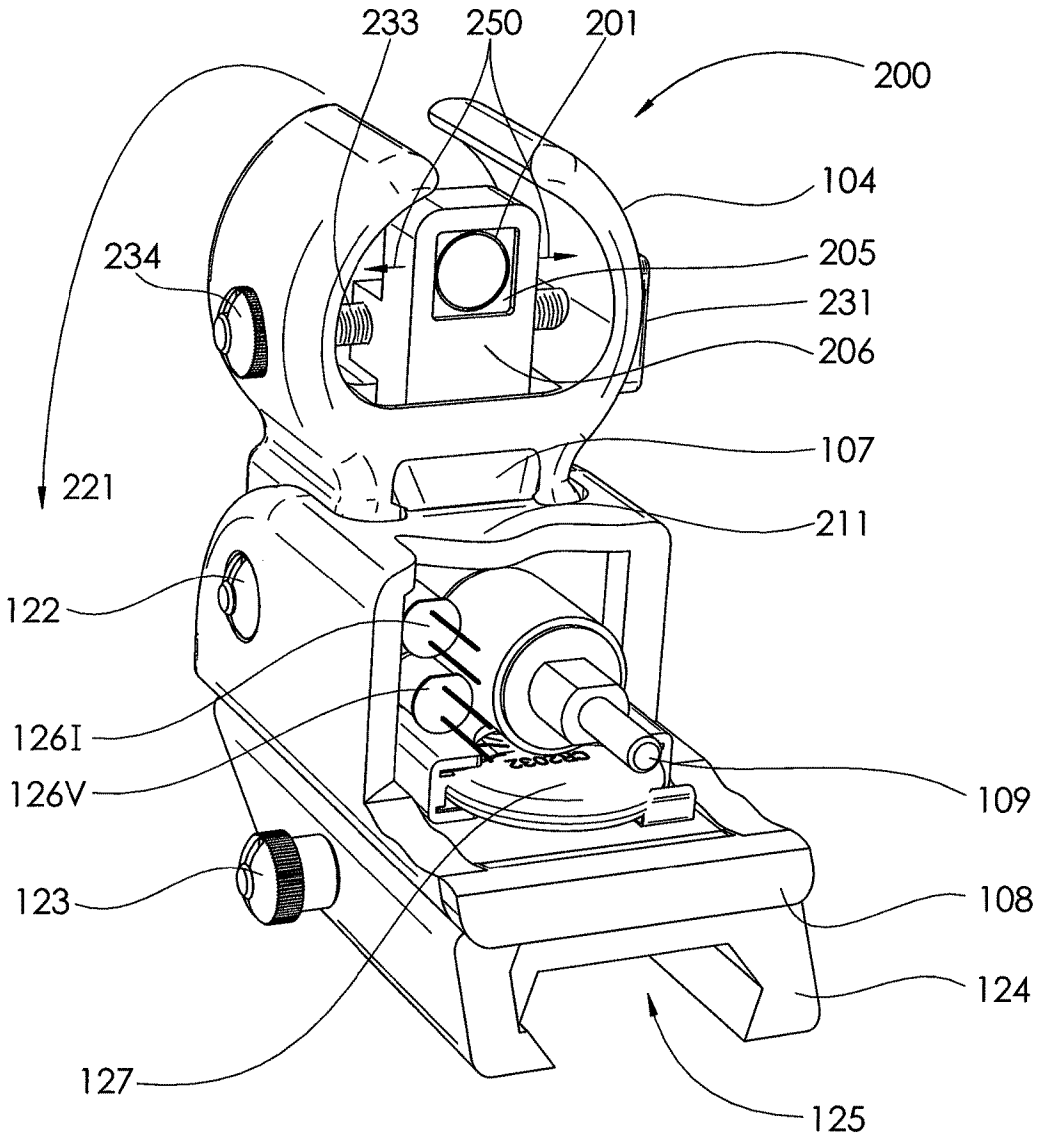
FIG. 9 is another upper rear perspective view of the rear sight assembly of FIG. 8 without cap.

FIG. 7 is an upper front perspective view of the rear sight assembly 200 for the LED (light emitting diode) illuminating weapon lighting system. FIG. 8 is an upper rear perspective view of the rear sight assembly 200 of FIG. 7. FIG. 9 is another upper rear perspective view of the rear sight assembly 200 of FIG. 8 without cap 108.

Figure 10:
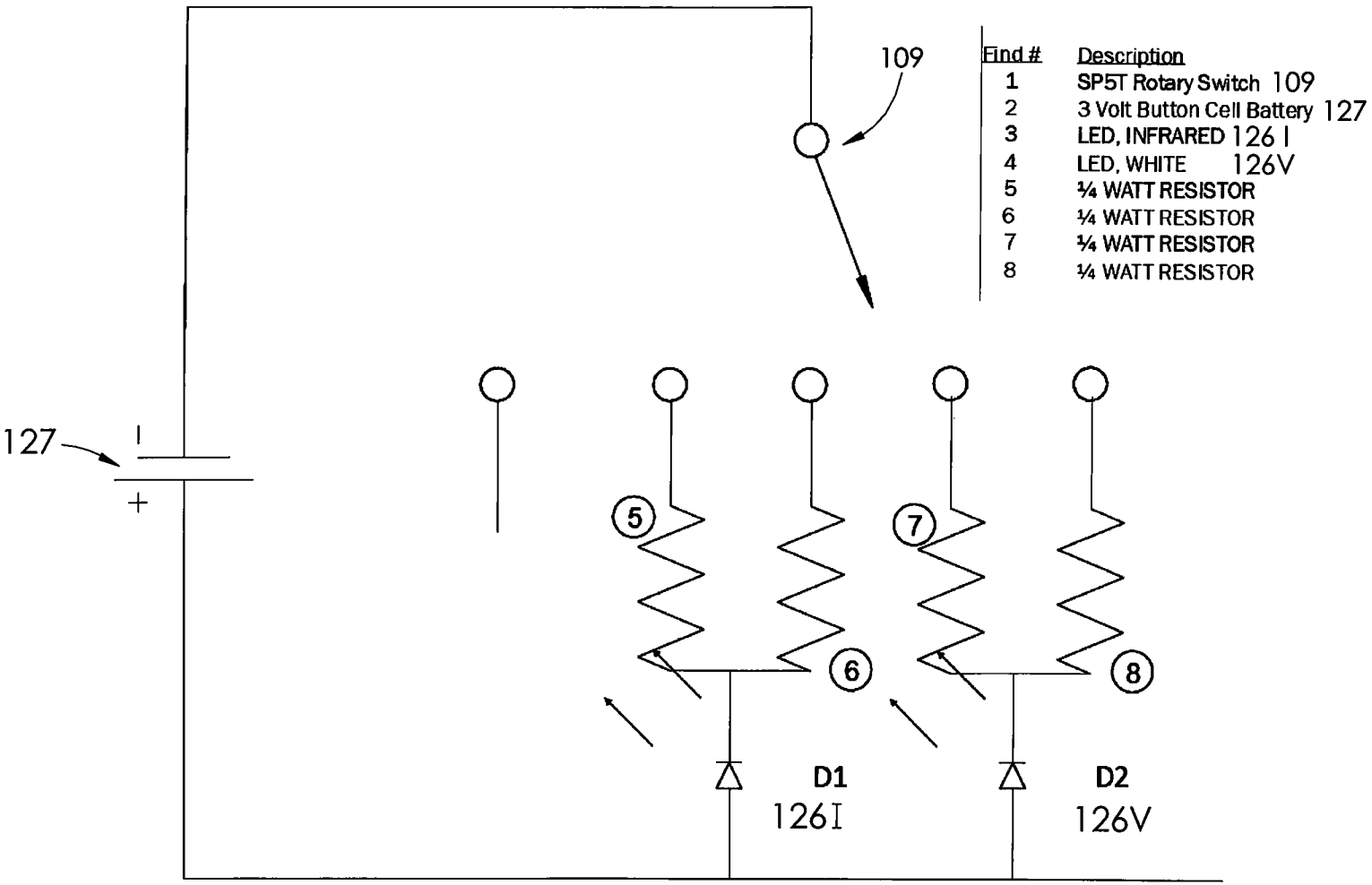
FIG. 10 shows the circuitry for use in both the rear sight assembly and front sight assembly of FIGS. 1-9.

FIG. 10 shows the circuitry for use in both the rear sight assembly 100 and front sight assembly 200 of FIGS. 1-9.

Figure 11:
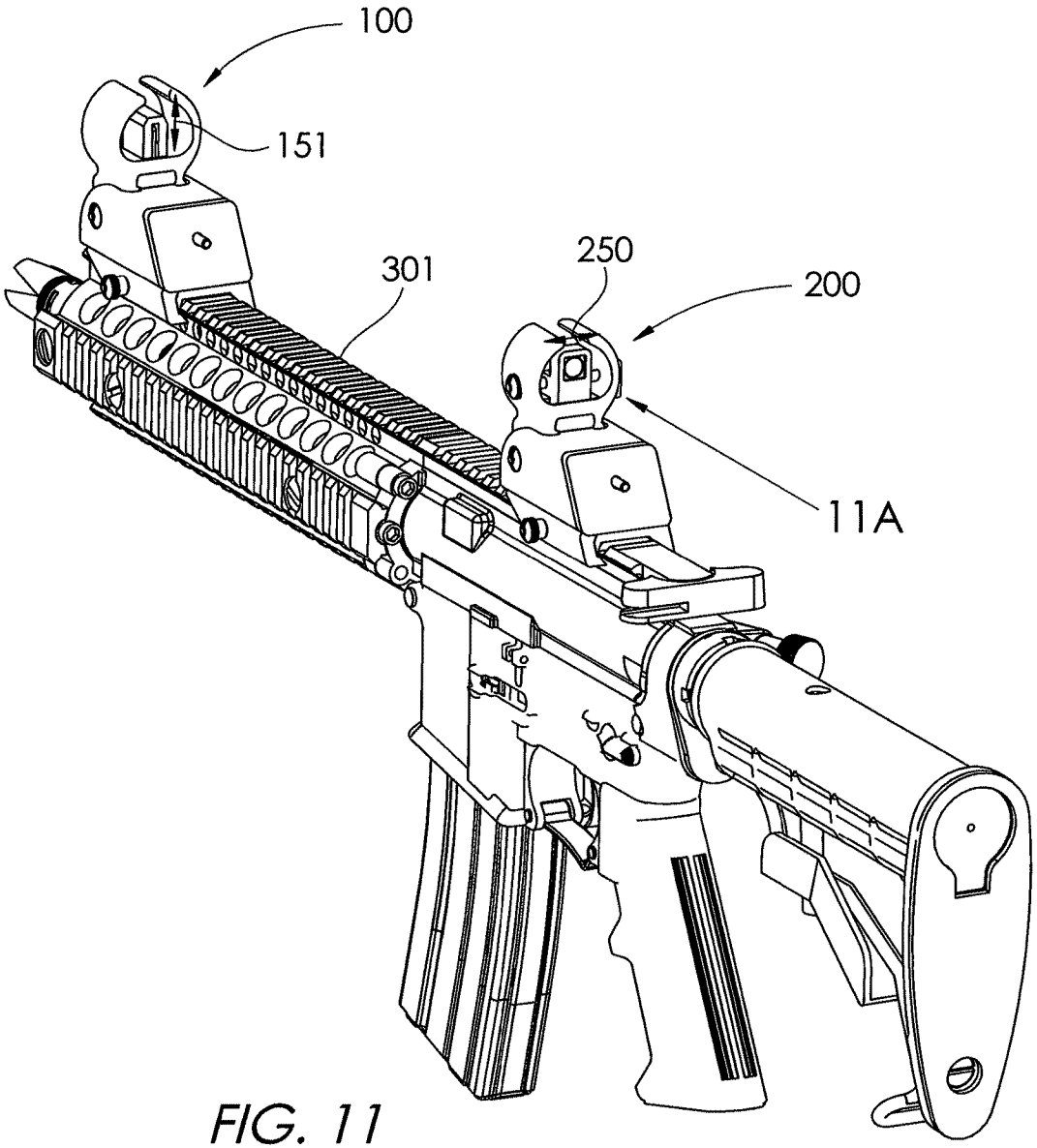
FIG. 11 is an upper rear perspective view of the front and rear sight assemblies of FIGS. 1-10 mounted on a weapon.

FIG. 11 is an upper rear perspective view of the front sight assembly 100 and rear sight assembly 200 of FIGS. 1-10 mounted on a picatinny rail 301 on an automatic weapon.

Figure 11A:
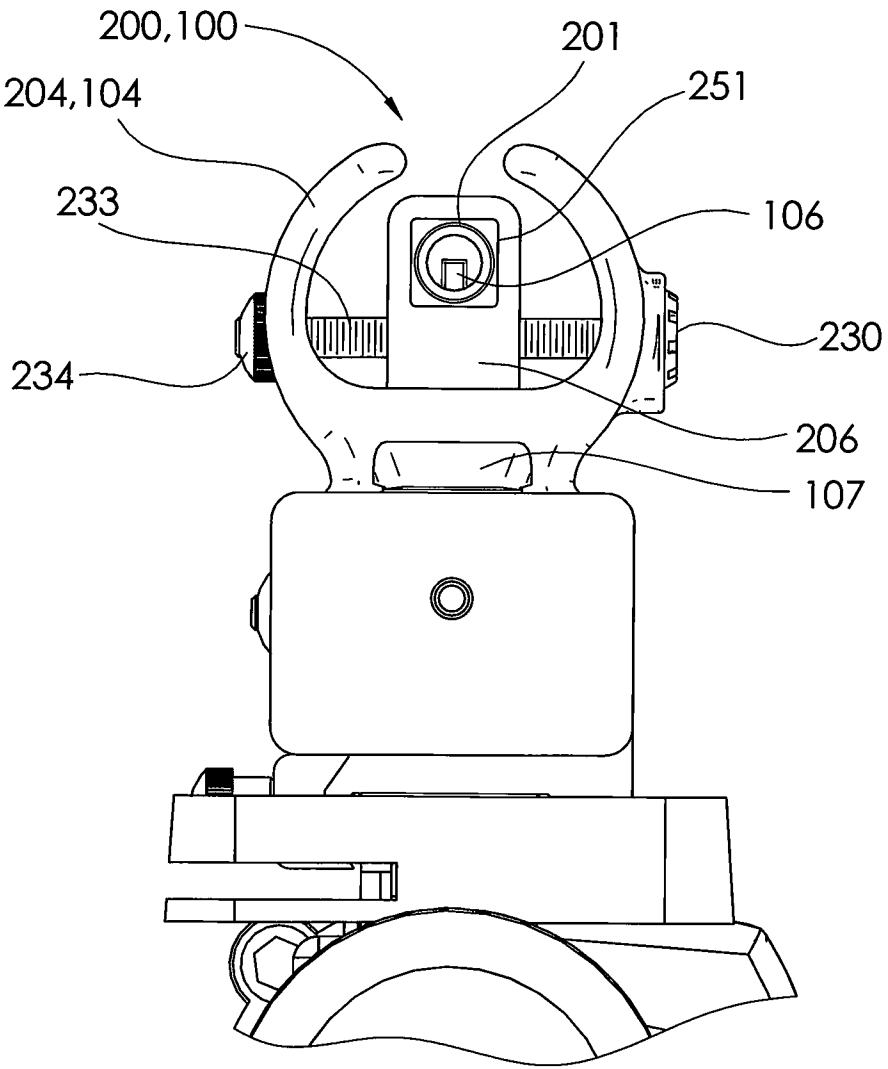
FIG. 11A is an enlarged rear view of the rear sight assembly and front sight assembly on the weapon of FIG. 11 along arrow 11A which is the direction of a shooters vision.

FIG. 11A is an enlarged rear view of the rear sight assembly 200 and front sight assembly 100 on the weapon of FIG. 11 along arrow 11A which is the direction of a shooters vision.

Figure 12:
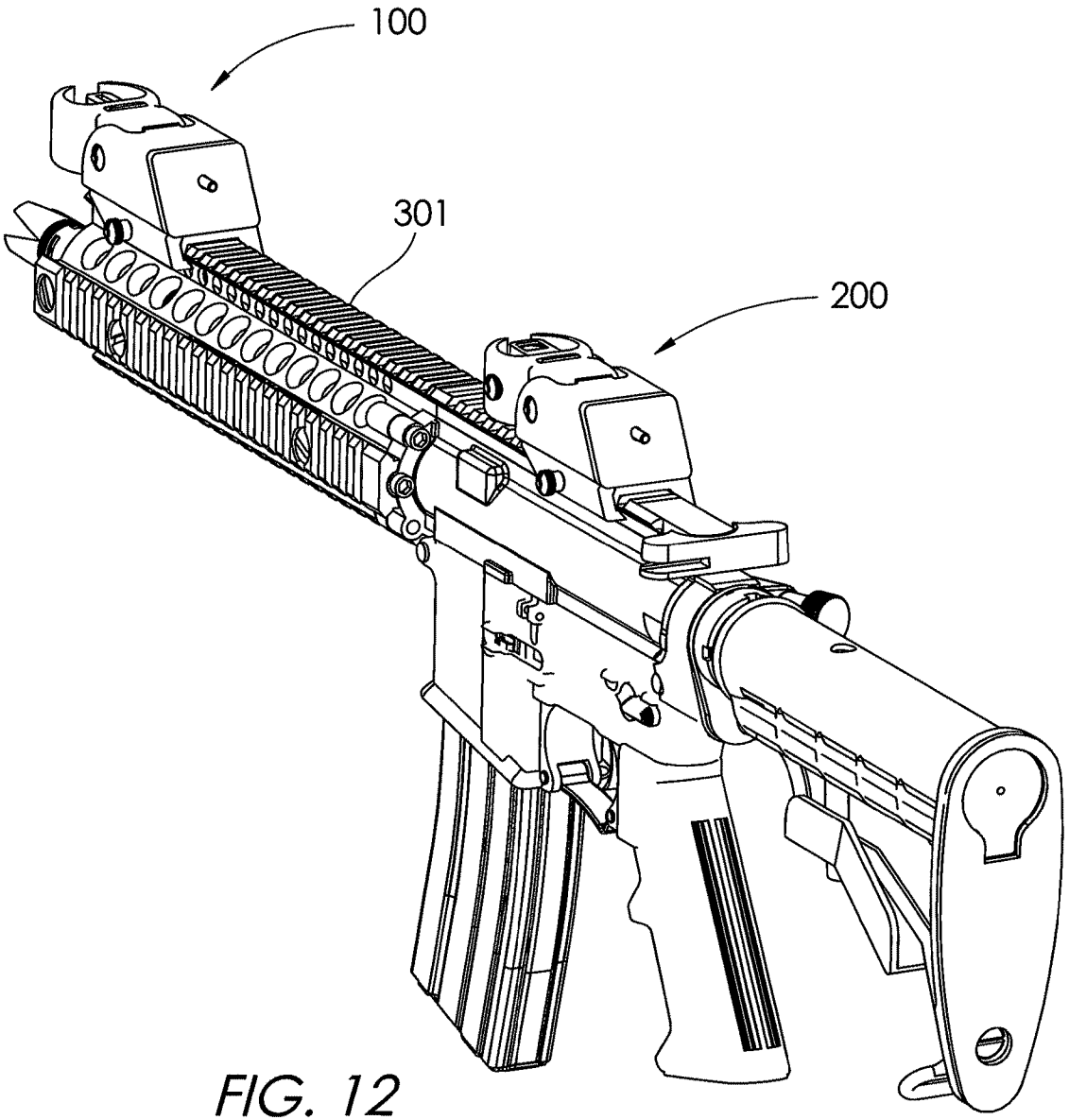
FIG. 12 is another upper rear perspective view of the front and rear sight assemblies of FIG. 11 mounted on a weapon with the front and rear sight assemblies folded down.

FIG. 12 is another upper rear perspective view of the front sight assembly 100 and rear sight assembly 200 of FIG. 11 mounted on a weapon with the front and rear sight assemblies 100, 200 folded down.

Figure 13B:
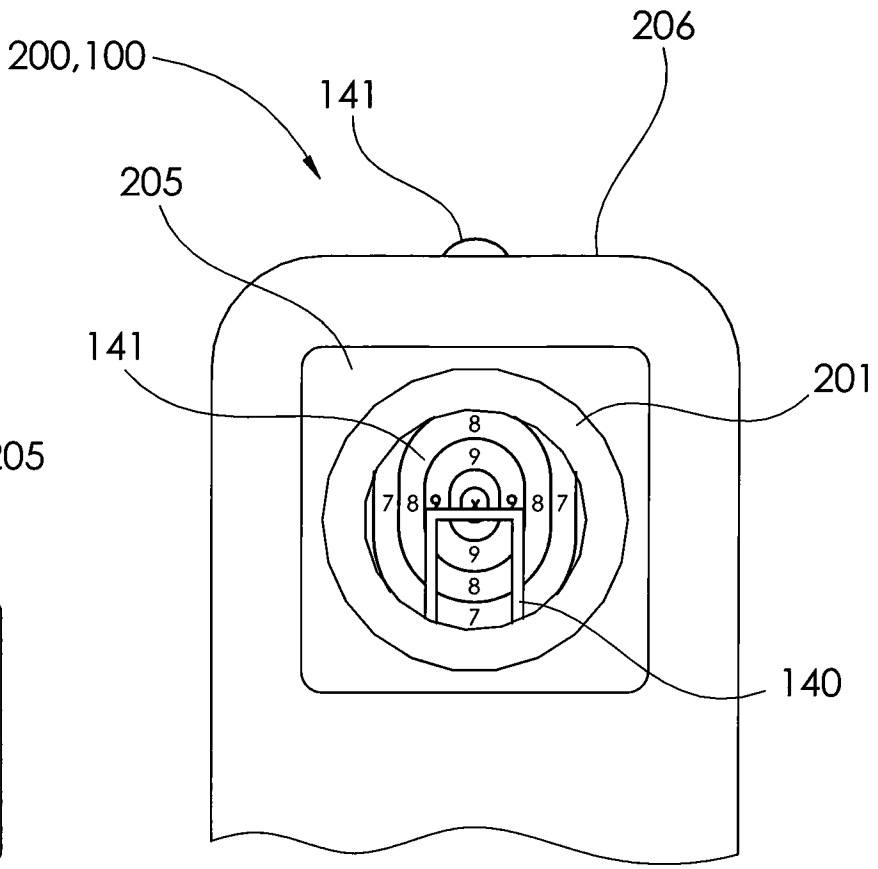
FIG. 13B is another enlarged view of the reticle housing in rear sight assembly aligned to front sight assembly of FIG. 13A when viewing a target.
Figure 13A:
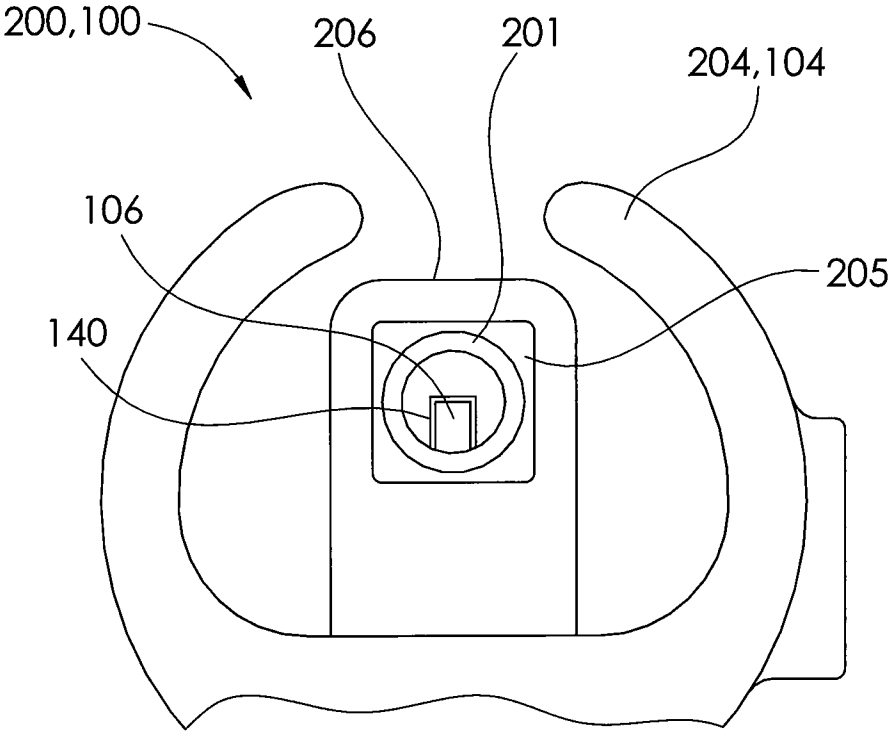
FIG. 13A is another rear enlarged view of FIG. 11A through the rear sight assembly aligned with the front sight assembly.

FIG. 13A is another rear enlarged view of FIG. 11A through the rear sight assembly 200 aligned with the front sight assembly 100.

FIG. 13B is another enlarged view of the reticle housing 206 in rear sight assembly aligned to front sight assembly 100 of FIG. 13A when viewing a target 141.

Referring to FIGS. 1-9, the LED Illuminating weapon sighting system is a light weight, weapon mounted, LED illuminated, iron sight system that can be made from a polymer plastic, aluminum, steel, combinations thereof, and the like. The novel system can include two parts; a rear sight assembly 200 mounted closest to a shooters eye and a front sight post assembly 100 mounted near the muzzle of a weapon, as shown in FIG. 11 These two assemblies 100, 200 can align with the shooters eye and target creating what is known as a "sight picture".

As shown in FIG. 12, the sighting system front assembly 100 and rear sight assembly 200 can flip down when the shooter no longer is using the system, such as during transport or when the weapon and system is being installed. The front assembly 100 and rear assembly 200 can flip up when the system is ready to be used.

Referring to FIGS. 1-6, the front LED sight assembly 100 can include a battery powered flip up blade post 105, 110 that the shooter will focus on while looking through the rear aperture of the rear assembly 200 (to be described later) aligning the two assemblies 100, 200 with a target. This system can use a unique LED lighting system to help the shooter acquire their "sight picture" in low light environments.

The front sight assembly can include one IR (Infrared) LED (light emitting diode) 126I used for night vision illumination. This light is only visible with the use of night vision goggles (NVG), and the system can include one visible LED (light emitting diode) 126V used for standard illumination without the use of NVG's. The front sight assembly can be powered by a battery 127, such as but not limited to a 2032 lithium battery. A switch 109 such as but not limited to a rotary switch can be used for on/off and the changing of the LED's 126I, 126V brightness. The rotary knob can be a C&K Model MA00S1Nz6D manufactured by C&K of Newton, Mass.

The front sight assembly 100 can include a telescopic adjustable bladed post 105, 110 for sighting the systems elevation. A knob, such as a rotatable knob 101 can be rotated left counter-clockwise or right clockwise in the direction of arrow 150 with horizontal gear 130 and gear contact 134 with vertical gear 132 to raise and lower front sight post housing 131 up and down in the direction of double arrows 151

The LED lights 126I, 126V can be housed in a base 111. The LED lights 126I, 126V can use a fiber optic rod 128 to channel the light up into the fiber optic board 106 bladed inside the front sight post housing 131. When turned on, the front sight post will illuminate either visible light or IR. The front sight post is facing the shooter and does not project light.

Referring to FIGS. 7-9, the rear sight assembly 200 can include of a battery powered flip up round aperture 201 the shooter will look through to align the front sight post and target. This system can use a unique LED lighting system to help the shooter acquire their "sight picture" in low light environments.

The rear sight assembly 200 can include one IR (Infrared) LED 126I used for night vision illumination. This light is only visible with the use of night vision goggles (NVG). The rear sight assembly 200 can include one visible LED 126V used for standard illumination without the use of NVG's. The rear sight assembly 200 can be powered by a battery 127, such as but not limited to a 2032 lithium battery. A switch 109 such as but not limited to a rotary switch can be used for on/off and the changing of the LED's 126I, 126V brightness.

An adjustable aperture for sighting the systems windage can be controlled by a windage adjustment knob 230 being rotatable clockwise or counter-clockwise in the direction of arrow 251 is attached to a windage screw 233 for providing left and right movement 250 of the reticle housing 206.

The LED lights 126I, 126I, can be housed in the base 211. A fiber optic rod 128 (FIG. 6) can be used to channel light from the lights 126I, 126V into the fiber optic board 205 located around rear aperture 201. A circle 201 can be etched into the fiber board 205

When turned on the etched circle will illuminate either visible light or IR (infrared light). The etched circle is facing the shooter around the rear aperture 201 and does not project light.

Referring to FIGS. 1-13B, the user can mount the front sight assembly 100 as close to the weapons muzzle on a picatinny rail 131 as possible. The user can mount the rear sight assembly 200 on the picatinny rail 301 of the weapon as close to the shooters eye as possible. The sight assemblies 100, 200 can be mounted onto the weapons picatinny rail by removing the lock bolt 112 located on the base 111, 211 of both sight assemblies 100, 200. The sight assemblies 100, 200 can be slid onto the weapons picatinny rail 301 through the Picatinny channel 125 located on the bottom of the base 111, 211 on both sight assemblies 100, 200. Once the sight assemblies 100, 200 are in the correct position on the weapon, the Picatinny lock bolt 112 can be slid into the base 111, 211 of both assemblies 100, 200. Next, the bolt 112 is tightened into the Picatinny locking nut 123.

While the sight assemblies 100, 200 are not in use the upper assembly of both sights will be folded down in the 180 degree position 121 as shown in FIG. 12. When in use the shooter can rotate the upper portion of the sight assemblies 100, 200 into the 90 degree position 121 locking the upper assembly of both sight assemblies 100, 200 onto the bases lock 107/129.

The operation of the sight assemblies 100, 200 is normal as long as the environment has light. In low light or no light environments, the shooter can turn both sight assemblies 100, 200 on by rotating the rotary switch 109 to a selected position. The shooter has the option of Infrared or visible lighting on the sights 126. If the shooter is using night vision goggles the rotary switch 109 can be rotated to the selected infrared LED 126 brightness position.

If night vision goggles are not being used, the shooter can rotate the rotary switch 109 to the selected visible light LED 126 brightness position. The front sight post can have a fiber optic board 106 that illuminates and faces the shooter.

The rear sight assembly 200 can have a fiber optic board 205 with an etched circle 201 that illuminates and faces the shooter. Once the shooter has identified a target 141, the shooter can line up both front and rear sights to get a good sight picture 140. Looking through the rear sights fiber optic reticle 205 and focusing on the front sight post fiber board 106, the shooter will align them with the target creating a clear sight picture. The shooter can engage the target 141 and evaluate the accuracy of the shots taken.

If adjustments need to be made for windage the shooter can rotate the windage knob 230 located on the rear sight assembly 200, left or right in the direction of arrow 151 to the correct direction needed.

If the elevation needs to be adjusted the shooter can rotate the elevation knob 101 located on the front sight post assembly 100, left or right in the direction of arrow 150 to the correct direction needed.

If the sights are no longer needed, the shooter can rotate both front and rear assemblies to the 180 degree position 121, 221 to the base 111, 211.

The electronics front cap 108 can be located on the base 111, 211 of both front and rear sight assemblies 100, 200 and can be removed to change the battery 127 as needed. An LED push button controller mounted on a circuit board can also be used in place of a rotary switch.

The LED controllers can be the same as the rotary switch. Controlling the on/off and also the brightness of the LEDs.

The novel system can use LED lights to illuminate both front and rear sight assemblies 100, 200 to make them useful in low light environments. Modern day iron sights are ineffective in low light due to the shooters inability to see both front and rear components of the system.

Military or Law enforcement can benefit from the IR function of the novel system greatly do to the shooters ability to acquire the sights in low light environment without projecting any visible light with the use of night vision goggles (NVG's).

Being battery powered with an on/off and dimmer switch gives the shooter the ability to use the system at their convenience without projecting light. Having a rotary switch allows the projected light to be adjusted, unlike tritium sights which give off a constant light source.

Weapons that can use the novel front and rear sight assemblies can include but are not limited to any types of rifles and pistols that have mounting rails that include picatinny rails, M-Lok rails, which is a modular locking accessory mounting system for direct attachment for hard mounting accessories to a negative space mounting point and KeyMod rails which is an open source universal attachment system.

The term "approximately" can be +/−10% of the amount referenced. Additionally, preferred amounts and ranges can include the amounts and ranges referenced without the prefix of being approximately.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. An LED illuminating weapon sighting system, comprising:

a rear sight assembly having a rear base for mounting on an automatic weapon and a flip up reticle housing, adapted to be closest to a shooters eye, the rear sight assembly including a rear LED (light emitting diode) lighting system including at least one rear LED mounted in the rear base and rear light transmissive structure to illuminate the reticle housing; and a front sight post assembly having a front base for mounting on the weapon adjacent to a muzzle of the weapon and a flip-up post, the front sight assembly including a front LED (light emitting diode) lighting system including at least one front LED mounted in the front base and front light transmissive structure to illuminate the post, wherein the rear sight assembly and the front sight post assembly are adapted to align with the shooter's eye and target to create a sight picture and the rear LED lighting system and the front LED lighting system are adapted to assist the shooter to acquire the sight picture in low light environments.

2. The LED illuminating weapon sighting system of claim 1, wherein the at least one rear LED of the rear LED lighting system and the at least one front LED of the front LED lighting system each comprise multiple LEDs including:

an IR (Infrared) LED light used for night vision illumination; and a visible LED light used for standard illumination without the night vision illumination.

3. The LED illuminating weapon sighting system of claim 2, wherein the rear LED lighting system includes:

a rear fiber optic rod; and a rear fiber optic board positioned about a rear aperture, with a circle etched onto the rear fiber optic board, wherein turning on the rear sight assembly will channel light from the IR LED light and the visible LED light to illuminate the etched circle with the IR LED light or the visible LED light.

4. The LED illuminating weapon sighting system of claim 3, wherein the front light transmissive structure of the front LED lighting system includes:

a front fiber optic rod; and a front fiber optic board inside of a front sight post, wherein turning on the front sight assembly will channel light from the IR LED light and the visible LED light to illuminate the front sight post with the IR LED light or the visible LED light.

5. The LED illuminating weapon sighting system of claim 4, wherein the rear LED lighting system includes:

a rear battery power supply and a rear switch for turning on the rear LED lighting system and for adjusting brightness of the rear IR LED light 25 source and the rear visible LED light source.

6. The LED illuminating weapon sighting system of claim 5, wherein the rear switch includes: a rotary switch.

7. The LED illuminating weapon sighting system of claim 4, wherein the rear LED lighting system includes:

a windage adjuster to move a rear sight left or right to correct direction of the rear sight assembly.

8. The LED illuminating weapon sighting system of claim 4, wherein the front LED lighting system includes:

a front battery power supply and a front switch for turning on the rear LED lighting system and for adjusting brightness of the front IR LED light source and the front visible LED light source.

9. The LED illuminating weapon sighting system of claim 8 wherein the front switch includes: a rotary switch.

10. The LED illuminating weapon sighting system of claim 4, wherein the front sight post in the front LED lighting system includes:

a telescoping adjustable front sight post for sighting elevation of the target.

11. The LED illuminating weapon sighting system of claim 1, wherein the front sight assembly and the rear sight assembly each include:

clamps for mounting the front sight assembly and the rear sight assembly about picatinny rails on the weapon.

12. The LED illuminating weapon sighting system of claim 1, wherein the front sight assembly and the rear sight assembly each include:

clamps for mounting the front sight assembly and the rear sight assembly about M-Lok rails on the weapon.

13. The LED illuminating weapon sighting system of claim 1, wherein the front sight assembly and the rear sight assembly each include:

clamps for mounting the front sight assembly and the rear sight assembly about KeyMod rails on the weapon.

14. The LED illuminating weapon sighting system of claim 1, wherein the front sight assembly and the rear sight assembly each include:

pivot members for allowing upper portions on the front sight assembly and the rear sight assembly to fold up when being used and fold down when not being used.

15. The LED illuminating weapon sighting system of claim 1, wherein the rear LED lighting system and the front LED lighting system each includes:

an IR (Infrared) LED light used for night vision illumination.

16. The LED illuminating weapon sighting system of claim 1, wherein the rear LED lighting system and the front LED lighting system each includes:

a visible LED light used for standard illumination.

* * * * *